US005337492A

United States Patent [19]

Anderié et al.

[11] Patent Number: 5,337,492

[45] Date of Patent: Aug. 16, 1994

[54] SHOE BOTTOM, IN PARTICULAR FOR SPORTS SHOES

[75] Inventors: Wolf Anderié, Aurachtal/Falkendorf, Fed. Rep. of Germany; Edgar Stüssi, Mutschellen, Switzerland

[73] Assignee: adidas AG, Herzogenaurach, Fed. Rep. of Germany

[21] Appl. No.: 50,391

[22] Filed: May 6, 1993

[51] Int. Cl.[5] ..... A43B 13/18

[52] U.S. Cl. ..... 36/28; 36/7.8; 36/27; 36/114

[58] Field of Search ..... 36/7.8, 25 R, 27, 28, 36/31, 35 R, 114, 29, 3 B, 38; 267/35, 292, 158, 164, 165, 182, 160

[56] References Cited

U.S. PATENT DOCUMENTS

| | | | |
|---|---|---|---|
| 291,490 | 1/1884 | Buch | 36/28 |
| 832,987 | 10/1906 | Linwood | 36/38 |
| 1,202,732 | 10/1916 | Keough | 36/38 |
| 1,502,087 | 7/1924 | Bunns | 36/28 |
| 3,159,249 | 12/1964 | Lazan | 267/292 |
| 4,342,158 | 8/1982 | McMahon et al. | 36/28 |
| 4,535,553 | 8/1985 | Derderian et al. | 36/28 |
| 4,566,206 | 1/1986 | Weber | 36/7.8 |
| 4,593,482 | 6/1986 | Mayer | 36/28 |
| 4,638,575 | 1/1987 | Illustrato | 36/28 |
| 4,753,021 | 6/1988 | Cohen | 36/28 |
| 4,754,559 | 7/1988 | Cohen | 36/28 |
| 4,774,774 | 10/1988 | Allen, Jr. | 36/29 |
| 4,914,836 | 4/1990 | Horovitz | 36/28 |
| 5,010,662 | 4/1991 | Dabuzhsky et al. | 36/29 |
| 5,014,449 | 5/1991 | Richard et al. | 36/114 |

FOREIGN PATENT DOCUMENTS

| | | | |
|---|---|---|---|
| 3103230A1 | 1/1982 | Fed. Rep. of Germany . | |
| 3245182A1 | 5/1983 | Fed. Rep. of Germany . | |
| 3440206A1 | 5/1985 | Fed. Rep. of Germany . | |
| 958766 | 9/1949 | France | 36/28 |
| 425537 | 3/1967 | Switzerland | 36/28 |

*Primary Examiner*—Paul T. Sewell
*Assistant Examiner*—M. D. Patterson
*Attorney, Agent, or Firm*—Hoffmann & Baron

[57] ABSTRACT

A shoe bottom (2), in particular for sports shoes, having a plurality of individual flexurally resilient carrier elements (21) which are directed transversely with respect to the longitudinal direction of the shoe and which are arranged at spacings one behind the other in the longitudinal direction of the shoe. The carrier elements are connected to a cover plate portion (20) on the foot side and to an outsole layer (22) on the outward side. Each carrier element (21) is formed by a closed box profile with an upper web portion which extends transversely with respect to the longitudinal direction of the shoe, a lower web portion which is parallel to the upper web portion, two lateral support walls which connect the ends of the web portions together and bracing means supporting the upper web portion relative to the lower web portion. (FIG. 3).

29 Claims, 9 Drawing Sheets

Figure 1:
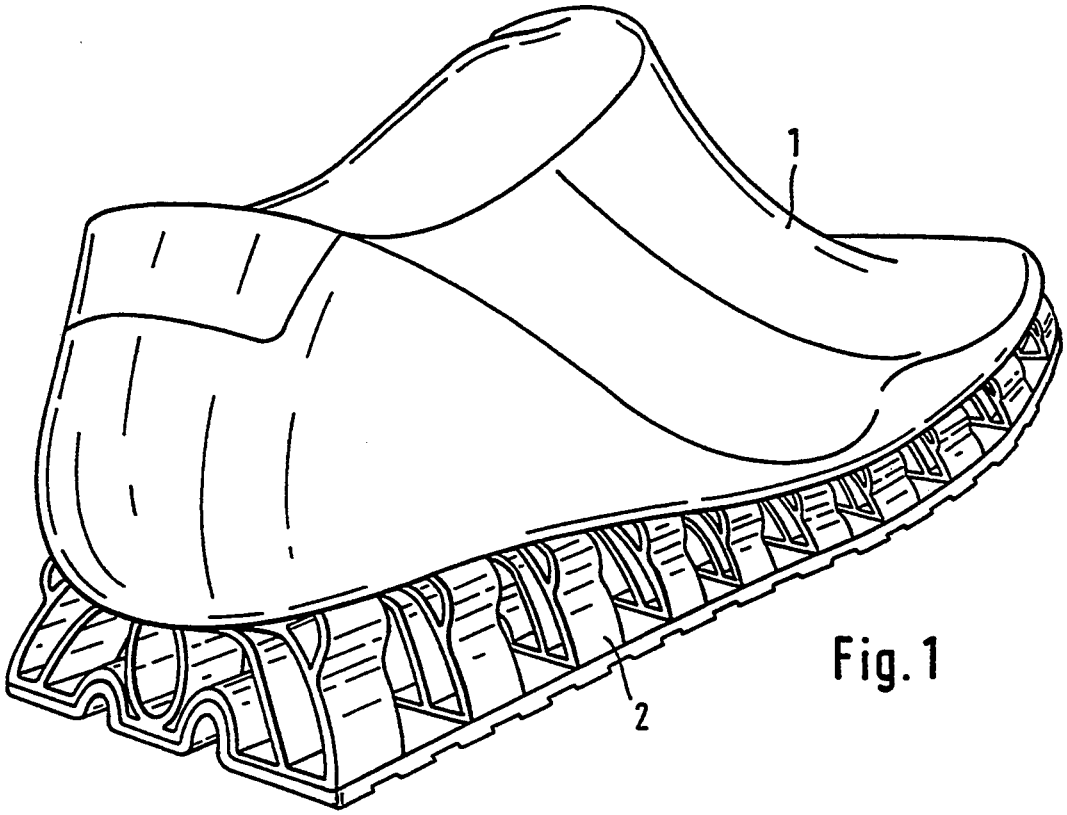

Fig. 27
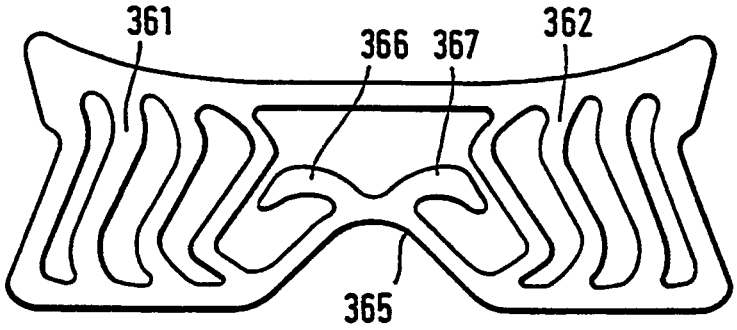
Fig. 28a
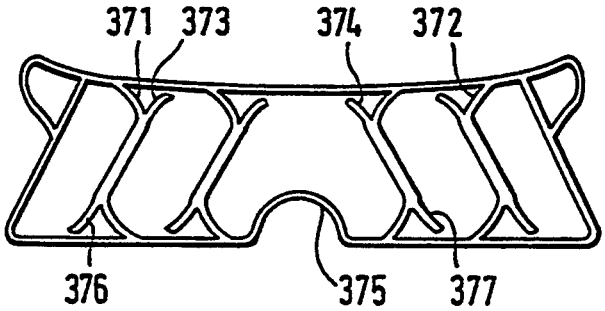
Fig. 28b
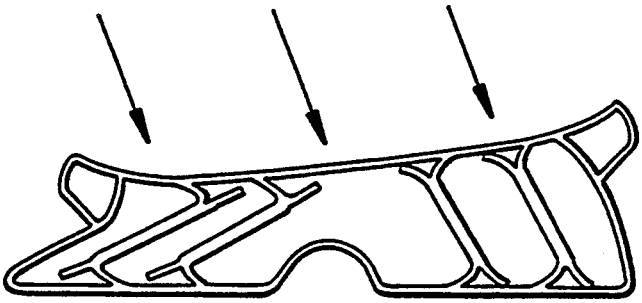
Fig. 28c
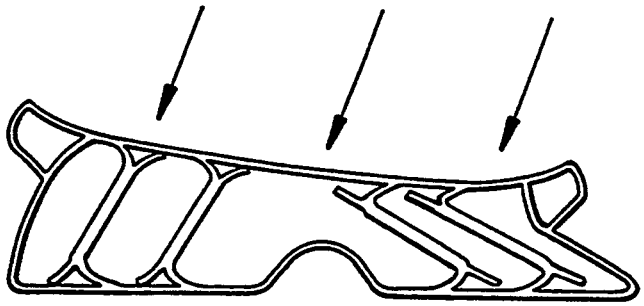
Fig. 28d

SHOE BOTTOM, IN PARTICULAR FOR SPORTS SHOES

The invention concerns a shoe bottom, in particular for sports shoes.

There is now wide-spread acceptance of the realization that shoes which are particularly intended for carrying on sporting activities must be adapted in terms of their design configuration to biomechanical aspects. That applies in particular in regard to the configuration of the shoe bottom, on and with which the rolling movement of the foot relative to the running track occurs, the function of the shoe bottom being on the one hand to reduce and distribute the impact forces which are in part considerable, in order to avoid adverse effects in terms of health, while on the other hand adequately stabilizing the foot and guiding it during the rolling movement thereof in such a way that the wearer retains a feel for the running track (track contact). For that purpose, in recent years, numerous proposals in regard to the design of outsoles have been made and in part also put into practice, such proposals being aimed at providing the minimum hindrance to the natural movement, which is desirable in itself, of the foot in the rolling motion thereof, while however influencing such movement to such an effect as to provide for the most possible advantageous transmission of force when the wearer of the shoe is running. Proposals along that line are directed to using different degrees of resilient flexibility in the individual portions of the sole in order to achieve a substantial damping effect at locations which are highly loaded by the forces involved, to restrict excessive pronation or supination and to take account of variations in the shape of the foot in itself, during the rolling movement thereof.

In all known shoe bottoms which have been developed for that purpose, flat sole portions of yielding material are used, in which case it is essentially the compression deformability of the material that is utilised to control the above-mentioned properties. In other words, the compression deformability of outsoles and possibly intermediate soles is influenced by local openings, inserts, and denser or less dense consistency of the sole material, and so forth. All those proposals which for damping, support and guide purposes, make use of the compression deformability of substantially flat soles or sole portions however encounter a limit in terms of combining the different requirements involved. That is due to the fact that a sufficient reduction in the foot forces which are high in particular when running fast on hard surfaces can really only be achieved by means of a relatively long deformation travel, that is to say, using soft sole material. However a long deformation travel presupposes a relatively thick outsole, by virtue of which however the runner loses the desired feel of contact with the track and which permits in particular not only deformation phenomena which are directed vertically relative to the track but also deformation phenomena which are directed laterally, that is to say parallel to the track, to a noticeable extent, thereby producing a floating feel. In order to prevent that from happening and in order to keep down the weight of the outsole, a comprise has therefore always been adopted, which amounts to a reduction in the damping capability. In addition, hitherto it has basically only been possible in practice, on the basis of a fairly reasonable production cost and resulting price, to adapt the compression deformability of mass-produced outsoles to the foot requirements, by means of the above-indicated measures. In that respect, it is always necessary to tolerate disadvantages which are due to the fact that durability suffers when the sole affords a degree of compression deformability which is made more intensive by means of openings therein, the weight of the sole is increased when the sole has harder inserts for reducing compression deformability and a different material consistency in the individual portions of the sole, particularly in different sizes of shoes, requires a considerable manufacturing expenditure.

A shoe bottom which is also already known (French patent specification No 958 766) uses non-flat sole portions with local measures for influencing the material flexibility, but provides a sandwich construction with individual carrier elements which are disposed between plate-shaped layers and which are arranged transversely to the longitudinal direction of the shoe bottom. Those carrier elements are tubular portions of rubber which are arranged parallel and in mutual contact, in which arrangement the degree of stiffness can be specifically locally adapted to the circumstances involved by means of inserted filling portions or springs. However that known shoe bottom which moreover is also not intended for sports shoes also cannot provide a fundamental solution to the above-discussed problem because, on account of the mutual contact and the resulting supporting effect of the tubular portions, at best their compression deformability but not their fundamental deformation characteristic is variable. There is also no expectation of a reduction in weight.

Therefore the object of the present invention is that of providing a shoe bottom of the specified kind, which affords an adequate damping effect and with which it is possible/easily to provide for adaptation of the deformation characteristics to the biomechanics of the foot in the rolling movement thereof, in the individual portions of the sole. The invention also seeks to provide that the weight of the shoe bottom is reduced.

The invention therefore moves away from the use of flat sole portions for a shoe bottom, which provide the intended functions by virtue of their compression deformability, and essentially replaces same by individual carrier elements, each of which represents a peripherally closed box profile with internal bracing means. The compression deformability of such a box profile is not based on the compressibility of the material, but on the flexural elasticity of the web portions, walls and bracing means of the box profile, wherein the deformation characteristics can be very substantially influenced and altered by virtue of the configuration and arrangement of the web portions, walls and bracing means relative to each other, and by virtue of their individual dimensions. Therefore, by relatively minor modifications in regard to the arrangement of the inner bracing means, it is possible to provide a multiplicity of carrier elements which can be deformed in different ways, and that makes it possible for the flexibility or yield characteristic of the sole bottom to be specifically controlled over the area of the sole bottom. In particular however the use of carrier elements of that kind, unlike solid compressible sole layers, makes it possible to produce a controlled and specific anisotropy which has the effect that the shoe bottom is noticeably more yielding in the direction in which it is subjected to a loading by virtue of weight, that is to say substantially perpendicularly to the surface of the outsole, than transversely to that direction. By virtue of making use of such anisotropy, it is possible to obtain comparatively long damping travel movements without that involving correspondingly substantial lateral deformability.

There are a number of options from the point of view of the man skilled in the art, in regard to the configuration and arrangement of the bracing or strut means within the box profile. A fundamental embodiment which gives a relatively simple configuration of low weight and with pronouncedly anisotropic characteristics in the above-indicated sense provides that each carrier element has at least one support arch portion which is attached by its ends to the lower web portion and adjacent respective ones of the support walls. In its simplest form the support arch portion forms a single curvature upwardly, that is to say it is of a bridge-like configuration, and its apex point is disposed approximately at the centre of the upper web portion. It is also possible however for the support arch portion to be of a wave-lie configuration so that in the centre, between the two upwardly directed curvatures, it forms an opposite curvature downwardly, the apex point of which is disposed approximately at the centre of the lower web portion. In those two embodiments, a pressure loading acting from above is divided by way of the upper web portion to the two side walls and to the curvature or curvatures of the support arch portion, the division occurring in the relationship of the levels of flexibility of the side walls and the support arch portion. At any event a substantial part of the pressure loading is passed to the lower web portion by way of the support arch portion, with simultaneous deformation thereof.

The deformation characteristic can be very substantially influenced solely by virtue of the fact that and the extent to which the support arch portion is connected with its curvature or curvatures to the upper web portion and possibly with its opposite curvature to the lower web portion. A fixed connection provides a greater degree of stiffening effect by virtue of which the support arch portion carries a greater proportion of the forces to be transmitted. If however the support arch portion is only fixed by its lower ends to the lower web portion and can move with its curvature or curvatures relative to the upper web portion, then it can deflect towards the side. In that case the arrangement provides a particularly pronounced anisotropic characteristic because for example in the event of a pressure loading at one side from above, for example when putting down the foot with the heel, the local flattening of the support arch portion on the loaded side gives rise to a correspondingly greater degree of curvature of the support arch portion on the less heavily loaded side, which results in a stiffening effect which is governed by the different kind of geometry.

The bracing or strut means may also be formed by annular or box profiles which are again closed and which are disposed in the interior of the carrier element. Thus, in another advantageous embodiment, there is at least one annular profile—which is then arranged centrally—and which extends from the upper web portion to the lower web portion and which is connected fixedly to at least one of the web portions.

In all the situations referred to, the carrier elements comprise a relatively hard, flexurally resilient plastic material, for example hard-set polyamide, polyurethane or polyester. Those plastic materials may also be reinforced by carbon or glass fibres.

The carrier elements are also arranged in the longitudinal direction of the shoe at a spacing from each other one behind the other and preferably in mutually parallel relationship, wherein at least their width varies according to the contour of the sole. In that respect the lateral support walls form the lateral edge surface of the sole which is however interrupted as a result of the spacing between the carrier elements. Particularly in the case of sports shoes, it is desirable for the sole to be of a flat wedge configuration which tapers forwardly. In that case the height of the individual carrier elements also varies accordingly.

The carrier elements may be produced by an injection moulding process in the individual sizes which together form a shoe bottom. It is however also possible for them to be produced by a continuous casting or extrusion process, and cut to the desired length.

An essential part of the carrier structure formed by the shoe bottom according to the invention is constituted by the cover layer or cover plate portion which is towards the foot side of the sole and which also consists of a relatively hard but flexurally resilient plastic material and which is joined to the upper web portions of the individual carrier elements, for example by adhesive. The outsole is connected to the lower web portions, for example by adhesive; the outsole also represents a significant part of the carrier structure and should also be flexurally resilient. At its side towards the ground, the outsole may carry a profiling, for example in the form of a wearing sole which is glued thereon. However, unlike the cover layer or cover plate portion, the outsole which is joined to the lower web portions is not an imperative requirement. On the contrary it would also be possible to omit the outsole so that the lower web portions with their undersides themselves form the ground-engaging side of the shoe bottom and for that purpose may possibly be provided with or fitted with a profiling.

A sole carrier in accordance with German patent specification No. 3 716 424 is advantageously suitable as the cover layer or cover plate portion.

Figure 2:
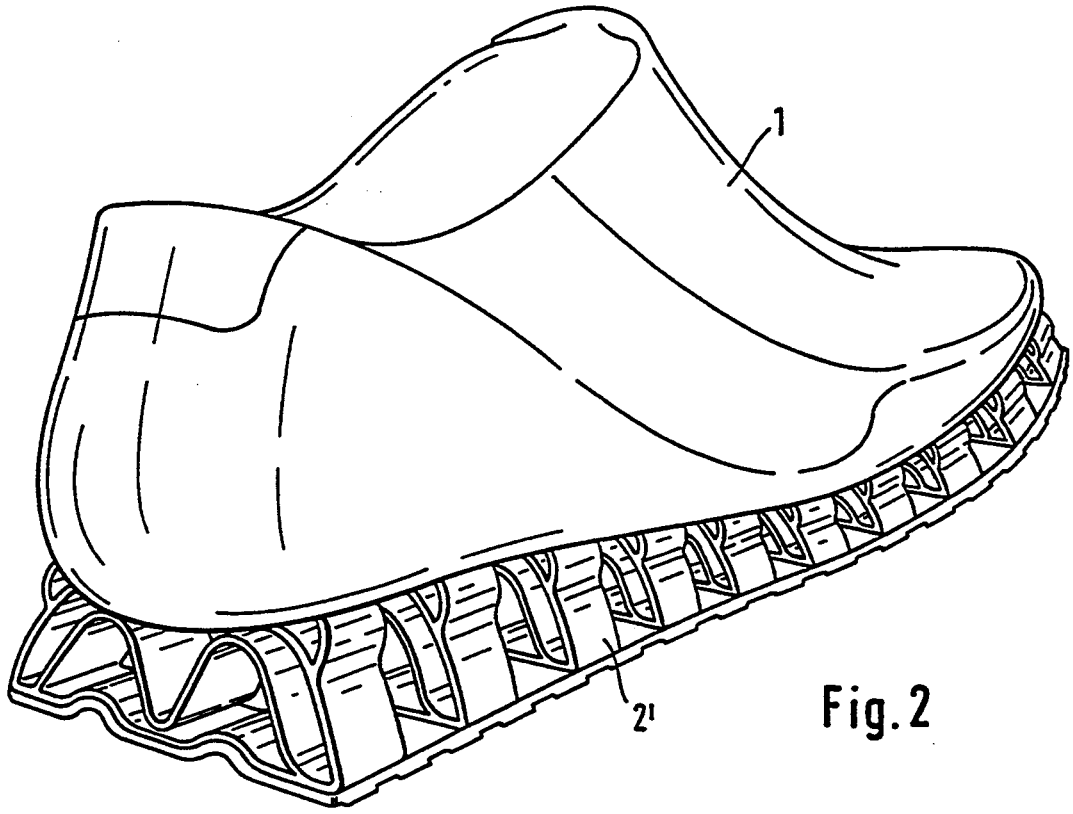
Figure 3:
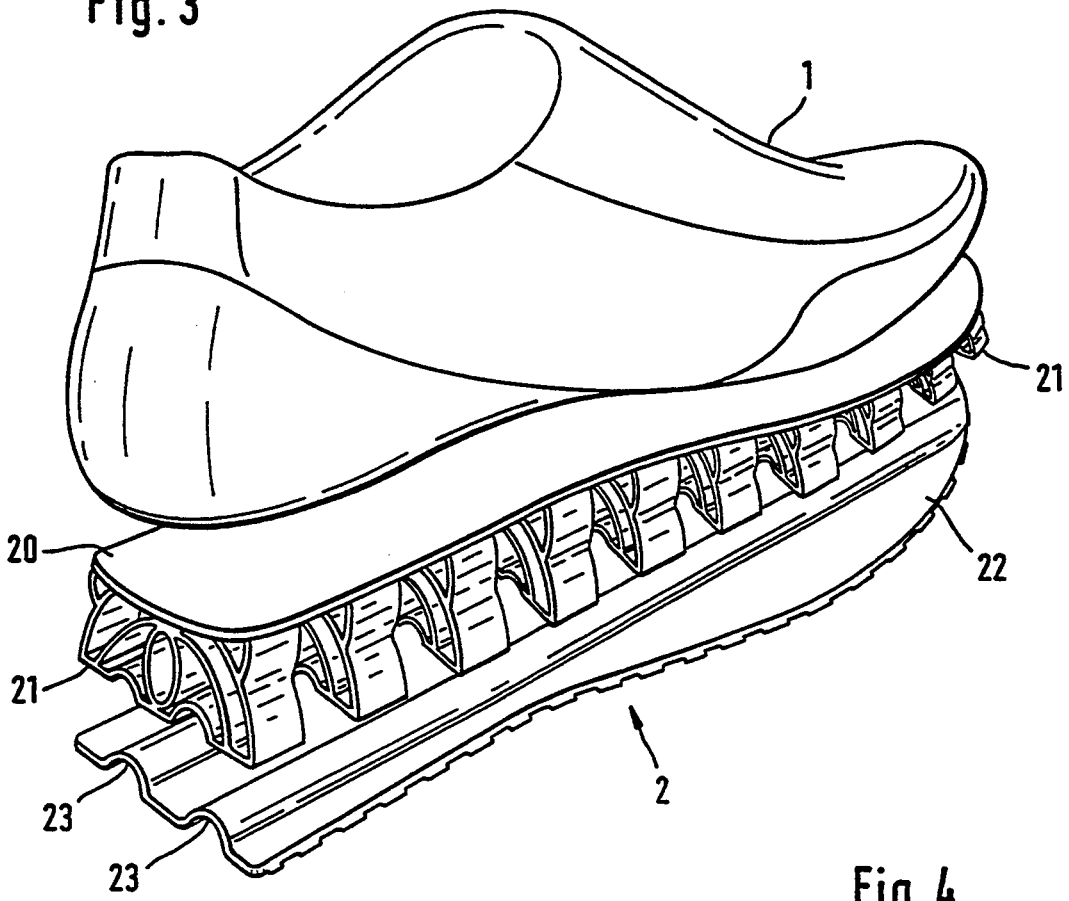
Figure 4:
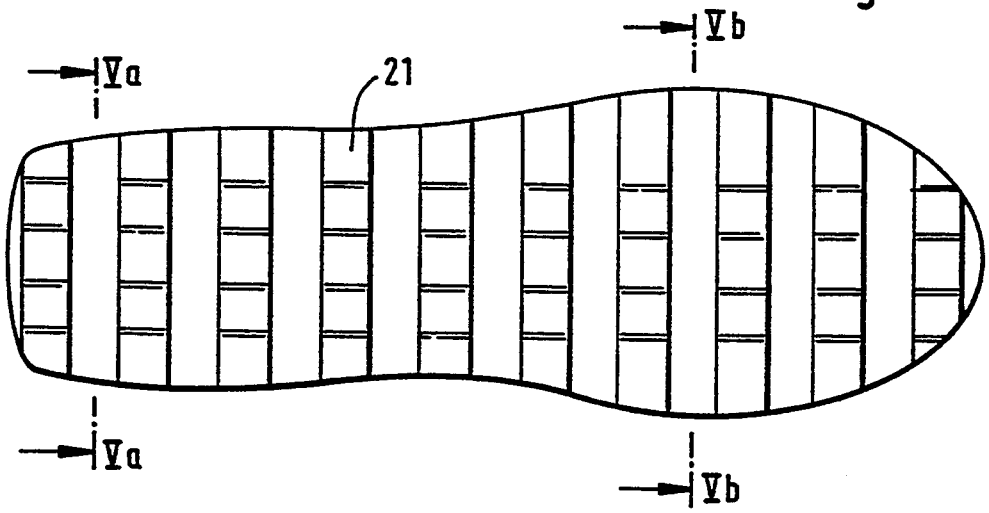
Figure 5A:
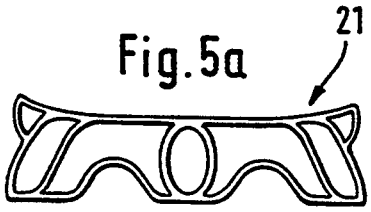
Figure 5B:
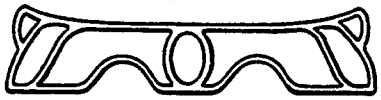
Figure 17:
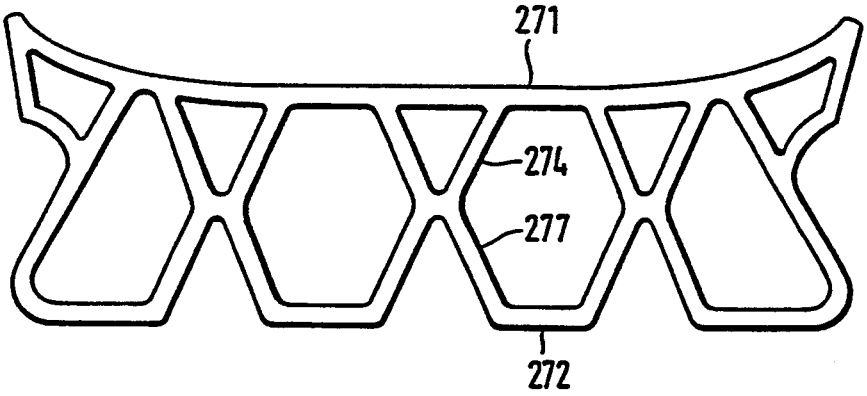
Figure 18:
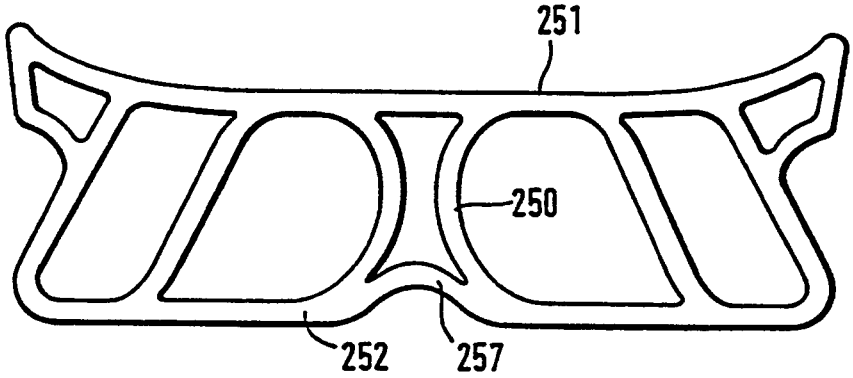
Figure 19:
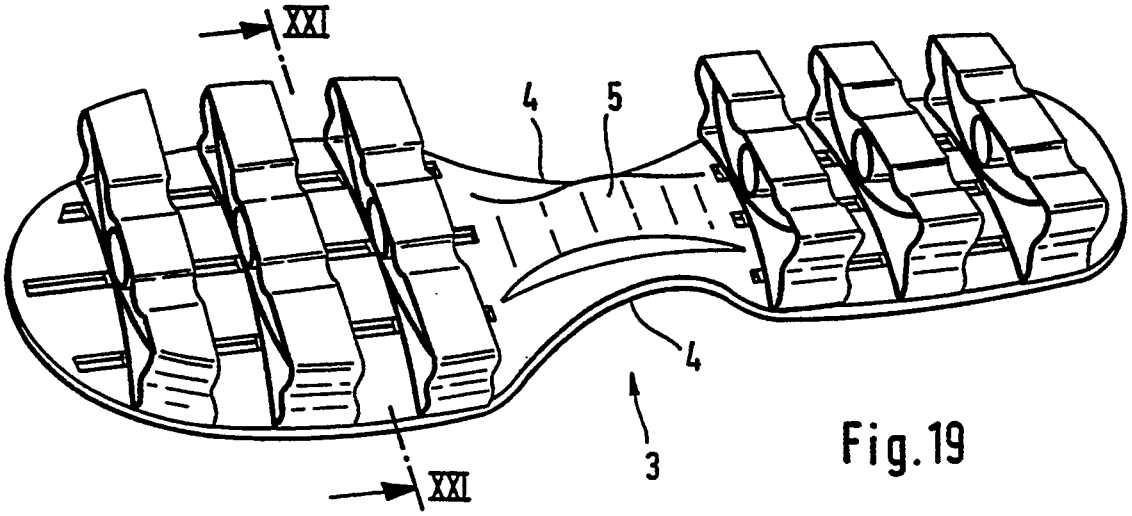
Figure 20:
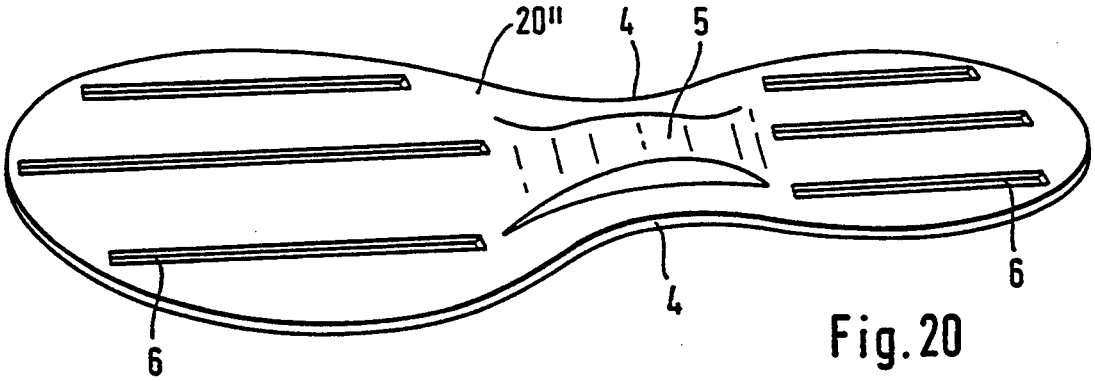
Figure 21:
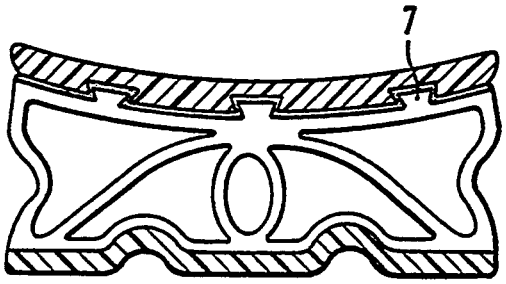

Further advantages and features of the invention will be apparent from the following description of embodiments with reference to the accompanying drawings and from further subsidiary claims. In the drawings:

FIG. 1 is a perspective but diagrammatic view of a sports shoe with a first embodiment of the shoe bottom according to the invention, FIG. 2 is a view similar to FIG. 1 showing a second embodiment of the shoe bottom, FIG. 3 is an exploded view which more clearly shows the individual parts of the sports shoe shown in FIG. 1, FIG. 4 is a view from below of the shoe bottom shown in FIG. 3 without the outsole layer, FIGS. 5*a* and 5*b* are views of the carrier elements in the shoe bottom shown in FIG. 3, viewed in the direction of the arrows Va and Vb respectively in FIG. 4, FIGS. 6 to 8*a, b* are views similar to FIGS. 3 to 5*a, b* of the sports shoe shown in FIG. 2, FIGS. 9 and 10 each show end views of a carrier element in the shoe bottom shown in FIG. 1 and in FIG. 2 respectively, illustrating the deformation characteristics of the carrier element when subjected to a loading at one side, FIGS. 11 to 18 show end views of possible embodiments of the carrier element on a larger scale than the natural scale, FIGS. 19 to 21 show a further embodiment of a shoe bottom according to the invention, FIG. 19 being a perspective view from below with the cover layer on the side towards the ground removed, FIG. 20 showing the cover layer on the foot side in a perspective view from below, and FIG. 21 being a section taken along line XXI—XXI in FIG. 19 but with the sole layer on the side towards the ground added thereto, FIGS. 22 to 26 are end views similar to FIGS. 11 to 18 of further embodiments of the cross-sections of carrier elements which are of an asymmetrical configuration with respect to their centre line to provide locally accentuated stiffness or flexibility, FIG. 27 is a corresponding view of a carrier element cross-section in which there are provided support bracing means which come into operation in the course of deformation, and FIG. 28 shows a series of deformation states under different loadings from above, which, in the case of a carrier element cross-section which is modified in comparison with FIG. 27, shows the effect of support bracing means which only come into operation during deformation of the carrier element.

The sports shoe shown in each of FIGS. 1 and 2 comprises an upper portion 1 and a shoe bottom which is generally identified by reference numeral 2 and 2' respectively. The upper portion 1 to which the present invention does not relate may be of any kind and configuration and may or may not have an insole (not shown). It is connected to the shoe bottom 2 or 2' for example by adhesive.

The view in FIG. 3 shows the individual components of the shoe bottom 2, more specifically a cover plate portion 20 of flexurally resilient plastic material, a number (which in the illustrated embodiment is ten) of carrier elements 21 which are also made from a relatively hard but flexurally resilient plastic material and an outsole layer 22 which at its outward or ground-engaging side has a profiling. In the illustrated embodiment the outsole 22 comprises a resiliently yielding material, for example rubber, which is of lower hardness and therefore greater compression deformability than the material of the carrier elements 21 and the cover plate portion 20.

Both the cover plate portion 20 and also the outsole layer 22 are of the sole shape which is known from conventional shoes. Corresponding to that shoe shape, the width of the carrier elements 21, which is measured transversely with respect to the longitudinal direction of the sole, is so selected that the carrier elements each extend as far as the outer edge of the cover plate portion 39 and the outsole layer 22, and reproduce the contour thereof. The carrier elements 21 may be of a thickness, as measured in the longitudinal direction of the sole, of from 0.5 to 1.5 cm, thus resulting in the spacings provided between them, with a given sole size.

The view in FIGS. 5*a* and 5*b* shows both the different widths and also the different heights of the carrier elements 21 in the individual sole portions. Thus the height of the carrier element 21 as shown in FIG. 5*a* is greater than that of the carrier element shown in FIG. 5*b*. The carrier elements 21 which are adjacent those carrier elements are of a height which respectively increases and decreases stepwise, thus providing the wedge-like shape of the shoe bottom which tapers towards the toe of the shoe and which is clearly visible in FIG. 1.

The carrier elements 21 each represent in themselves a box profile which is peripherally closed but open towards the ends thereof. The embodiment shown in FIGS. 5*a, b* corresponds to that of FIG. 11. Accordingly the carrier element 21 used in this embodiment comprises an upper web portion 201, a lower web portion 202, lateral support walls 203 and a support arch 204 which is arranged as a bracing or strut means in the interior of the profile cross-section. The support arch 204 has a single, upwardly directed curvature in the manner of a bridge and is 'attached' by its lower ends 205 to the lower web portion 202 at a small spacing (in the illustrated embodiment, about 1/10th of the overall width of the carrier element 21) from the lateral support walls 203. In addition the support arch 204 is coalesced to the upper web portion 201 in the curvature region over a width which approximately corresponds to half the width of the support arch.

Figure 11:
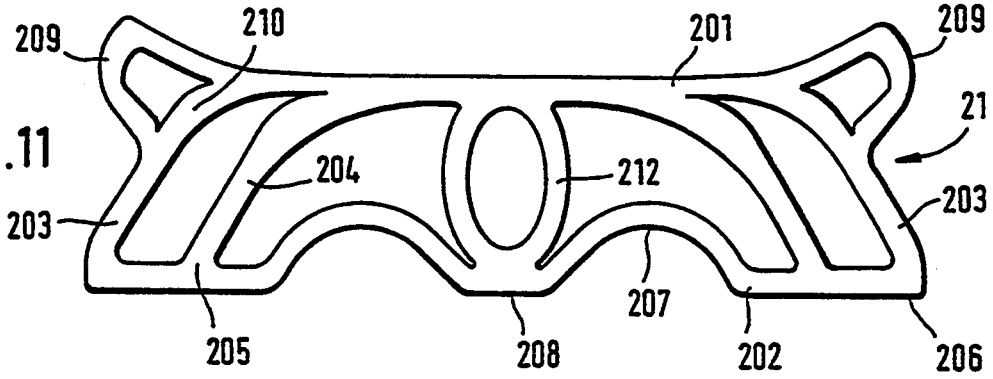

At its surface, in the middle region, the upper web portion 201 is substantially flat or is of an only shallowly curved configuration, whereas it is extended upwardly in its two end portions, to provide a foot bed (see FIG. 11). The lower web portion 202 has two end portions 206 which are flat at the underside and which are adjoined in an inward direction by two upwardly projecting curvature portions 207 which are arranged symmetrically with respect to the middle of the cross-section. The curvature portions 207 are connected together by a central portion 208, the underside of which is disposed at least approximately in one plane with the end portions 206. The curvature portions 207 project approximately as far as half the height of the respective profile cross-section of the carrier element 21.

The ends of the upper web portion 201 and the lower web portion 202 are connected together by the lateral support walls 203. The lateral support walls 203 each form a respective inwardly concave curvature, that is to say they are inclined inwardly in their lower half at an angle of about 60° relative to the horizontal and then curve outwardly again, forming a lateral ridge-like projection 209. The lower end of the ridge-like projection 209 is connected to the upper web portion 201 by a support strut portion 210. The upper web portion 201 is also supported at the central portion 208 of the lower web portion 202 by way of an oval-annular support profile portion 212 which is fixedly joined to the associated web portion, both at the top side and at the bottom side.

The thicknesses of the individual components which form the above-described profile or carrier element, namely the upper and lower web portions, the lateral support walls and the illustrated bracing means, are approximately 1.5 to 2.5 mm and may also vary in the course of the respective individual component. For reasons of simplicity of the drawing, they are shown herein as being of substantially uniform thickness.

Figure 9:
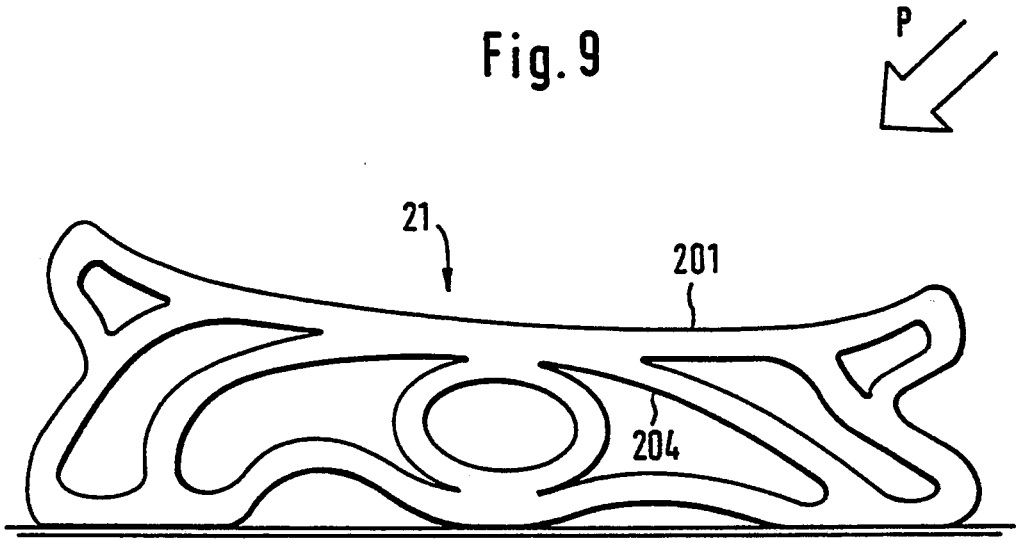

FIG. 9 is a purely diagrammatic view of the deformation characteristics of the carrier element 21 shown in FIGS. 5*a* , 5 and 11 when subjected to a lateral loading. When that carrier element is loaded centrally and perpendicularly from above, for example when the runner is standing thereon in a rest condition, then the individual components are correspondingly deformed in a substantially symmetrical fashion. When the loading as indicated by the arrow P acts obliquely from above and from the side, on the other hand, the support arch 204 is pressed flat at one side and also displaced somewhat towards the opposite side. That displacement results in an increase in the curvature of the support arch in the region which is in opposite relationship to the loading P, so that at the location the support arch becomes stiffer in relation to the loading which is still applied from above. Therefore, by virtue of that stiffening effect, the part of the carrier element profile which is disposed in opposite relationship to the loading P retains its original height to a greater degree than would be the case if there were a uniform loading over the width of the upper web portion 201. That stiffening effect also provides that the part of the cross-section which is involved therewith has a lower level of deformability towards the side, that is to say, the cross-section profile does not take up an oblique position, unlike the characteristics of a layer sole consisting of homogeneous or uniform material. That corresponds to the anisotropic characteristics referred to in the opening part of this specification, which reduces lateral displacement of the shoe bottom and thus prevent a floating feel.

The cover plate portion 20 which can be from 1.5 to 2 mm in thickness and which preferably comprise fibre-reinforced plastic material is fixedly connected by adhesive to the upper web portions 201 of the successively arranged carrier elements 21. In that way the cover plate portion 20 forms the holding arrangement for the carrier elements 21, to ensure that they are disposed at spacings from each other. The outsole layer 22 has two curved longitudinal ribs 23 which extend in the longitudinal direction and which converge towards the tip or toe of the shoe. The cross-sectional shape of the longitudinal ribs 23 is adapted to the contour of the curvature portions 207 of the carrier elements 21 and is also fixedly connected to them by adhesive. Moreover the outsole layer 22 is glued to the flat portions 206 and 208 of the lower web portion of the carrier elements 21.

Figure 6:
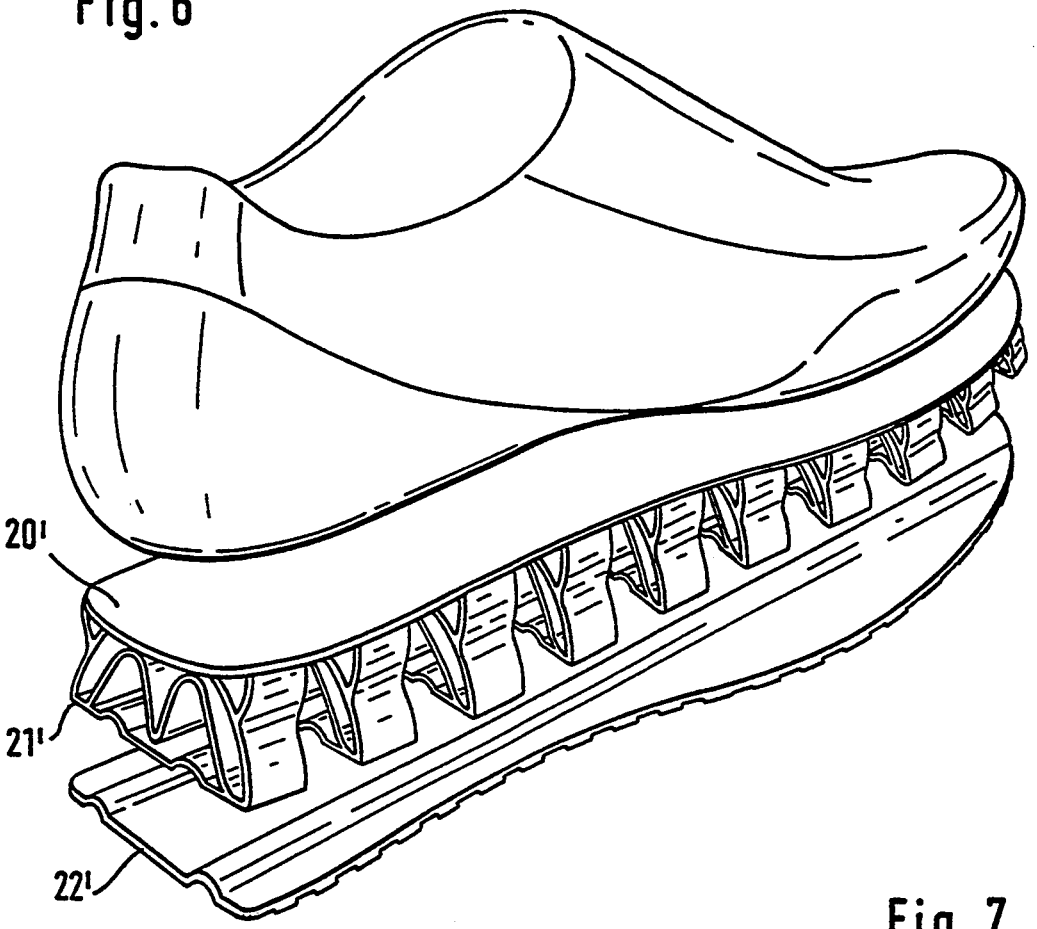
Figure 7:
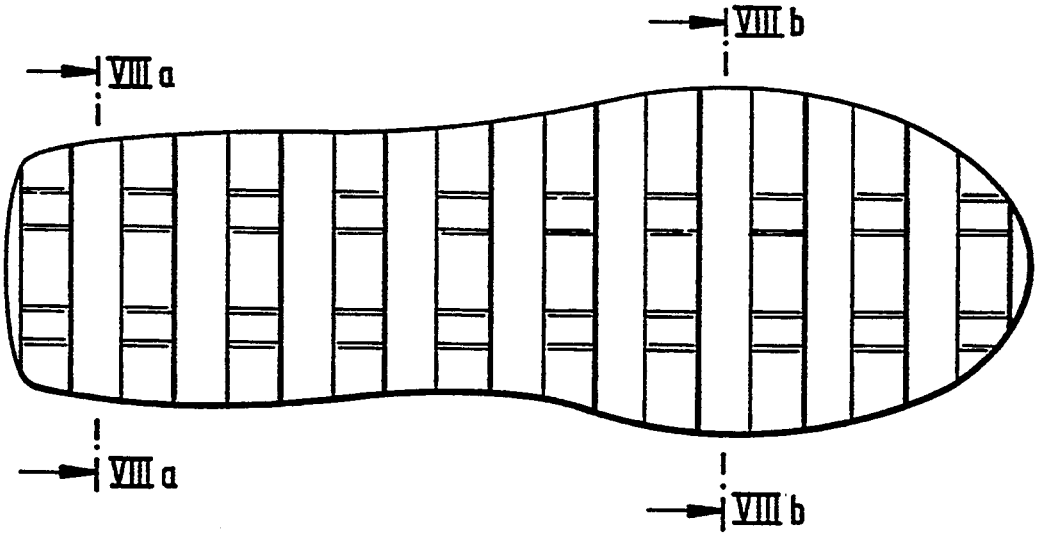

The view in FIGS. 6 to 8 similarly corresponds to that shown in FIGS. 3 to 5 and differs therefrom only in regard to the different configuration of the carrier elements 21'. For that reason there is no need for a separate detailed description of FIGS. 6 to 8.

Figure 8A:
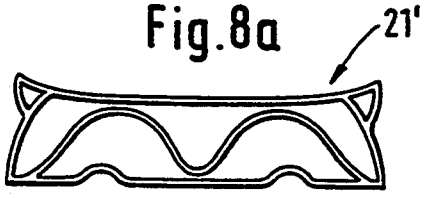
Figure 8B:
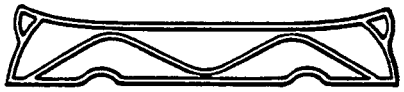
Figure 12:
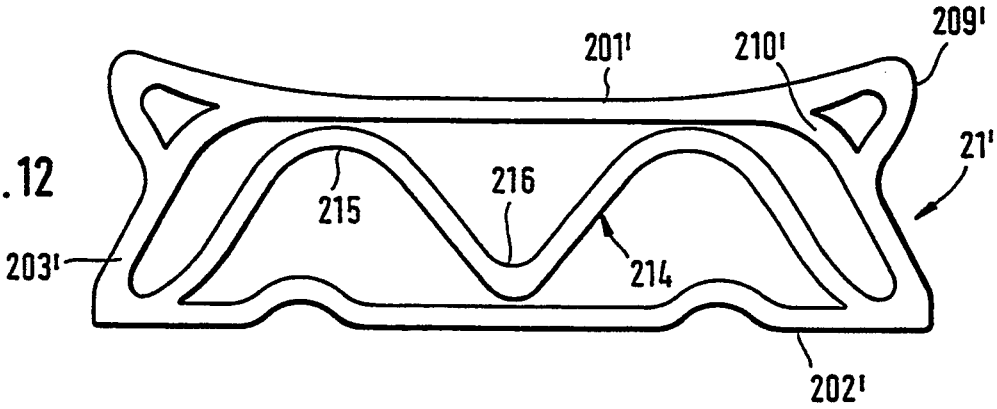

The carrier elements 21' shown in FIGS. 8*a* and 8*b* correspond in their structure to the view shown in FIG. 12. Those carrier elements also have an upper web portion 201', a lower web portion 202', lateral support walls 203' and a bead projection 209' on both sides, which is supported against the upper web portion 201' by a support strut 210'. In that respect the external contour of the box profile formed by the carrier element 21' is substantially the same as that of the carrier element 21.

The shape and arrangement of the inner bracing means of the carrier element 21' are different. They are formed by a support arch portion 214 which has two curvatures 215 which are directed upwardly symmetrically relative to the centre and a downwardly directed opposite curvature 216 which is between the curvatures 215. The support arch portion 214, like the support arch portion 204 of the carrier element 21, is fixed to the lower web portion 202' in the vicinity of the lateral support walls 203'. In other respects however it is not connected to the parts forming the periphery of the profile of the carrier element 21'; the apex points of the curvatures 215 and 216 are each at a spacing of from 1 to 2 mm from the associated web portion so that they can move relative thereto in the lateral direction.

Figure 10:
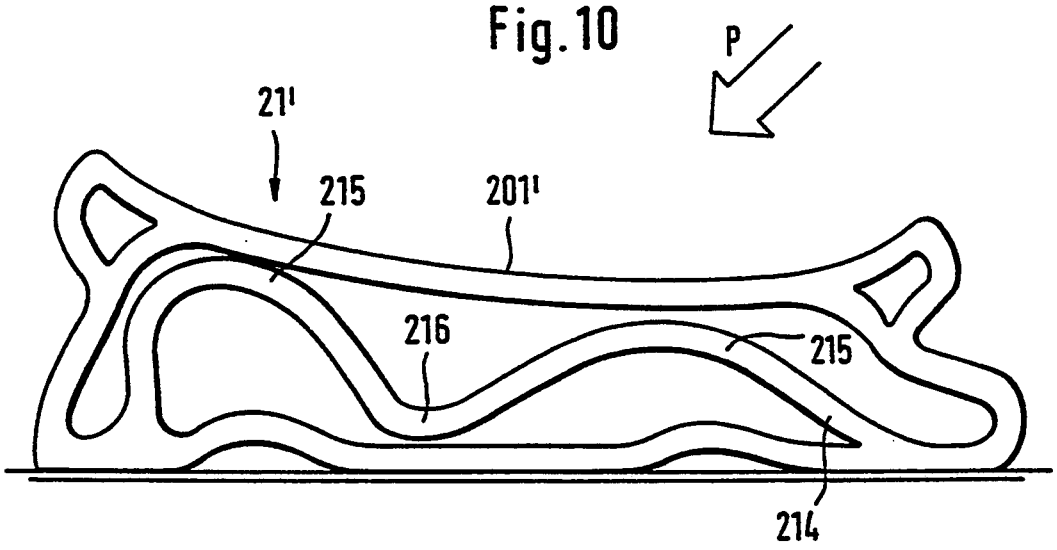

FIG. 10 clearly shows the deformation characteristics of the carrier element 21', which result from that configuration, under the effect of a force P acting at one side. Due to the loading at one side, the curvature 215 of the support arch portion 214, which is at the right in the drawing, is pressed flatter whereby the apex point of the opposite curvature 206 is displaced from the centre towards the oppositely disposed half of the profile cross-section. That displacement in turn results in a pronouncedly greater degree of curvature in respect of the left-hand curvature 215 which as a result comes into contact with the upper web portion 201' and on the one hand, by virtue of using up the spacing which was hitherto present therebetween, presses against same more strongly than previously while on the other hand due to the greater degree of curvature it provides a higher level of resistance to deformation by a loading acting from above. As a result overall the half of the cross-section of the carrier element 21' which is at the left in the drawing is stiffened so that no lateral 'floating away' phenomenon occurs.

FIGS. 13, 15, 16 and 18 show modified embodiments of the carrier elements having a support arch portion.

Figure 13:
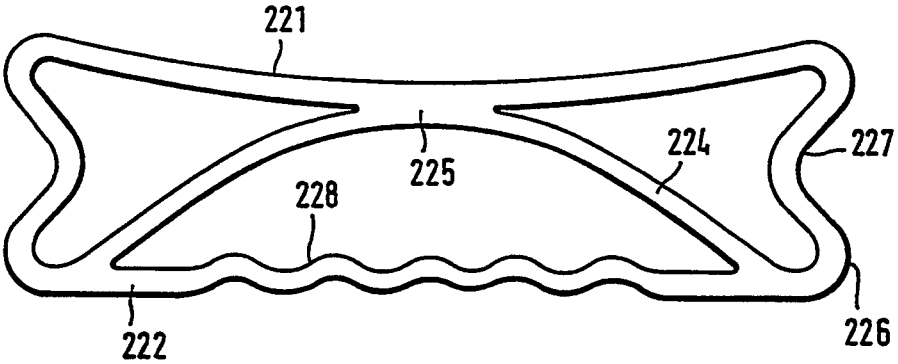

FIG. 13 shows the simplest embodiment of a box profile for a carrier element with a support arch portion 224 having a single curvature. The support arch portion 224 is fixed by its lower ends to a lower web portion 222 and by its apex point 225 to an upper web portion 221. The lateral support walls 226 have an inwardly projecting curvature 226 but they are not supported at the upper web portion 221 by an additional bracing means which approximately corresponds to the support strut 210. In its central portion the lower web portion 222 has a plurality of small inwardly directed curvatures 228 which are similar to a wave structure. The outsole layer (not shown) which is used in conjunction with carrier elements of this configuration has a corresponding number of longitudinal ribs which again correspond in terms of their cross-section to the wave structure.

The carrier element shown in FIG. 13 is more easily deformable and thus softer, in comparison with the carrier element 21 shown in FIG. 1.

Figure 15:
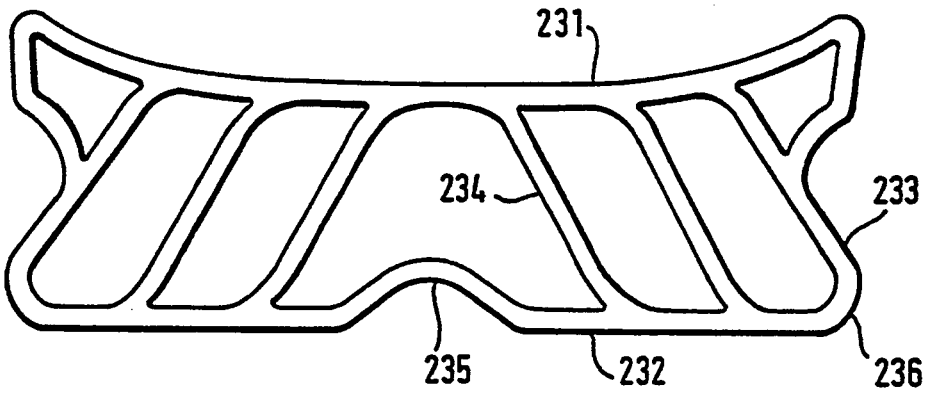

The carrier element shown in FIG. 15 differs from that shown in FIG. 11 essentially only by virtue of the configuration of the lower web portion 232 and replacement of the annular support profile 212 by a further support arch portion 234. The further support arch portion 234 is fixedly connected to the lower web portion 232 at both sides of a single central curvature portion 235 and by its apex region to the upper web portion 231. In addition the lateral support walls 233 blend into the lower web portion 232 with a marked rounded portion 236. The carrier element shown in FIG. 15 is stiffer in comparison with that shown in FIG. 11 and has a less pronounced anisotropic characteristic.

Figure 16:
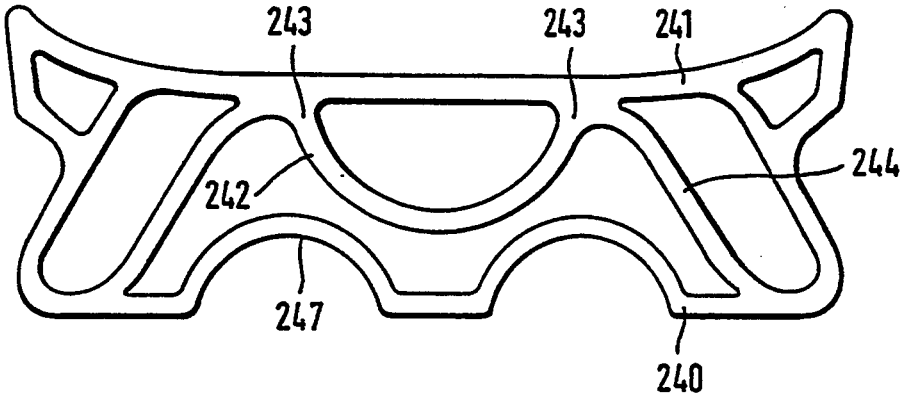

The carrier element shown in FIG. 16 differs from that shown in FIG. 11 only by virtue of the shape and arrangement of the central annular support profile. In other respects the design configuration is unchanged. In this embodiment the central support profile 242 is approximately in the shape of a semicircular arc and is fixedly connected by both ends 243 to the upper web portion 241 and the support arch portion 244 respectively. It extends in a direction towards the lower web portion 240 but it maintains a clear spacing of 2 to 3 mm from the two curvature portions 247 thereof. The carrier element in this embodiment is softer in comparison with that shown in FIG. 11 but stiffer than that shown in FIG. 13 and has a less pronounced anisotropic characteristic than both of those.

The carrier element shown in FIG. 18 differs from that shown in FIG. 11 once again by virtue of the different configuration of the lower web portion 252 and the central annular support profile 250. Otherwise it is unchanged. The lower web portion 252 has a single central curvature portion 257, to the two flanks of which are attached the lateral boundaries of the annular support profile 250. In this embodiment the support profile 250 is of a quadrangular cross-sectional shape with inwardly drawn side lines and is fixedly connected to the upper web portion 251. This carrier element is somewhat similar in regard to its deformation characteristic to that shown in FIG. 11.

Figure 14:
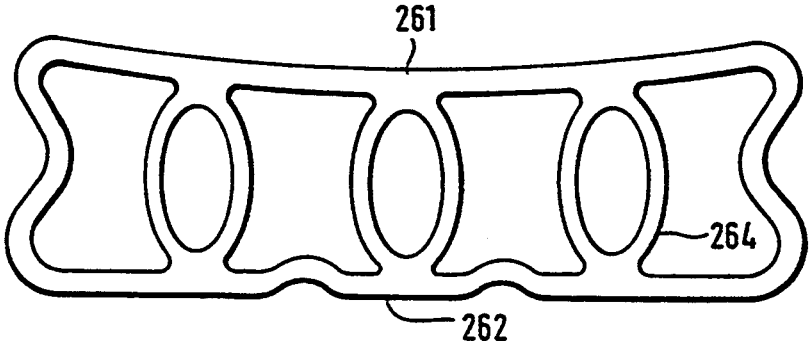

FIGS. 14 and 17 show embodiments of carrier elements in which the inner bracing means of the peripheral profile cross-section is formed by a plurality of annular support profiles. Thus the embodiment shown in FIG. 14 has three annular support profiles 264 which divide the upper web portion 261 and the lower web portion 262 into approximately equal parts and which are of a cross-sectional shape of an upright oval and which are fixedly connected to the web portions, by their upper and lower apex points.

In the embodiment shown in FIG. 17 three support profiles 274 which are approximately triangular in cross-section project downwardly from the upper web portion 271, the tips of the support profiles 274 being united with curvature portions 277 which project upwardly from the lower web portion 272.

FIGS. 19 to 21 show a particular embodiment of the cover plate portion 20'' of the shoe bottom, in which the region 3 at the arch of the foot is deliberately constricted by virtue of lateral recesses 4 in order to provide for substantial twistability of the front sole portion relative to the rear sole portion, but is also stiffened to resist flexing about a transverse axis by a hump-like thickened portion 5 which is directed in the longitudinal direction of the sole. Accordingly also only the front sole portion and the rear sole portion are provided with carrier elements while the region 3 at the arch of the foot is left free therefrom. The carrier elements can be of the kind as have been described hereinbefore in relation to the other embodiments.

In addition the cover plate portion 20'' is provided at its underside both in the front sole portion and also in the rear sole portion respectively with three dovetail-shaped grooves 6 which extend parallel to each other in the longitudinal direction and into which engage dovetail-shaped ribs 7 of the carrier elements, which correspond thereto in complementary fashion in regard to their cross-section. The ribs 7 can be sprung into the dovetail-shaped grooves 6, which presupposes a suitably flexibly deformable material for the cover plate portion 20'', or they can be pushed into the grooves 6, which requires at least an opening at one era of the grooves. The rib/groove connection is strengthened by an additional bracing means provided between the carrier elements and the underside of the cover plate portion 20''.

Figure 22:
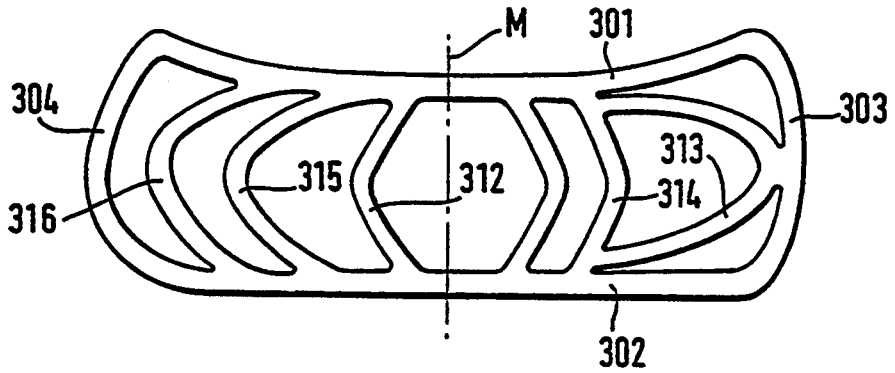

FIGS. 22 to 26 show different cross-sectional shapes of carrier elements, the common characteristic of which lies in a bracing means in the box profile, the bracing means being of an asymmetrical configuration relative to the perpendicular central plane M (see FIG. 22). Thus, the cross-sections shown in FIGS. 22 to 24 comprise an approximately centrally arranged, annular closed support profile portion 312, 322 and 332 respectively, of which the first two support profile portions are approximately in the shape of a regular hexagon while the last-mentioned annular support profile portion has support bracing portions which are drawn in at an angle and in that respect approximately corresponds to the annular support profile portion 250 shown in FIG. 18.

In the cross-section shown in FIG. 22, disposed on the right-hand side adjoining and outside the annular support profile portion 312 is a support bracing or strutting means in the form of half an elliptical arc 313 which at its side facing towards the centre, is closed by an angled support bar portion 314 which extends substantially parallel to the facing side of the annular support profile portion 312. The support bar portion 314 is supported against the upper web portion 301 and the lower web portion 302; the heavily curved outward side of the elliptical arc 313 is coalesced with the associated side wall 303. On the left-hand side of the box profile, two outwardly curved support bar portions 315 and 316 adjoin the annular support profile portion 312. The lateral support walls 303 and 304 of the box profile are curved convexly outwardly.

The aim of that asymmetric configuration of the carrier element cross-section is that of ensuring specific severer deformation at a location on the cross-section, in any situation, irrespective of the direction of loading. If for example in the case of the carrier element shown in FIG. 22, the aim is specifically to avoid overpronation at the heel, then the corresponding carrier elements are so arranged in the heel region of the sole that the elliptical arc portion 313 faces towards the medial side of the foot whereas the support bar portions 315 and 316 face towards the lateral side of the foot.

Figure 23:
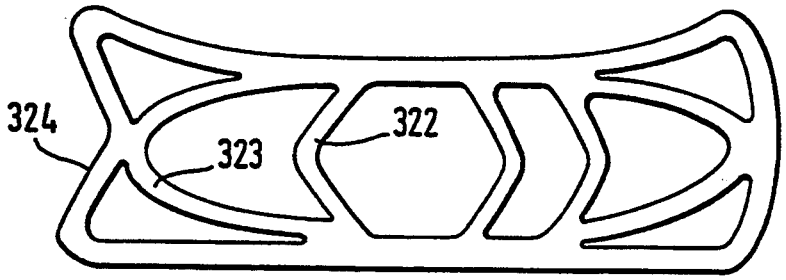

In the carrier element cross-section shown in FIG. 23, the right-hand side is of the same configuration as in the cross-section shown in FIG.22. The configuration of the left-hand half of the cross-section is different; in that half of the cross-section, instead of the support bar portions 315, 316, there is an open half elliptical arc portion 323 which is coalesced with its more heavily curved apex point to the inwardly curved or bent side wall 324. The ends of the elliptical arc portion 323 extend into the upper web portion and the lower web portion respectively in the immediate vicinity of the annular support profile portion 322.

In both cross-sectional shapes as shown in FIG. 22 and FIG. 23, that half of the cross-section in which the elliptical arc portion which is stiffened by a support bar portion is disposed is stiffer than the other half of the cross-section, in relation to loadings which act from above. If therefore, as mentioned in the previous example, carrier elements of that configuration are arranged at the heel on a sole carrier plate, wherein the cross-sectional half which is at the right in the drawing is disposed in a medial position, then the lower degree of yield at that location will resist overpronation.

Figure 24:
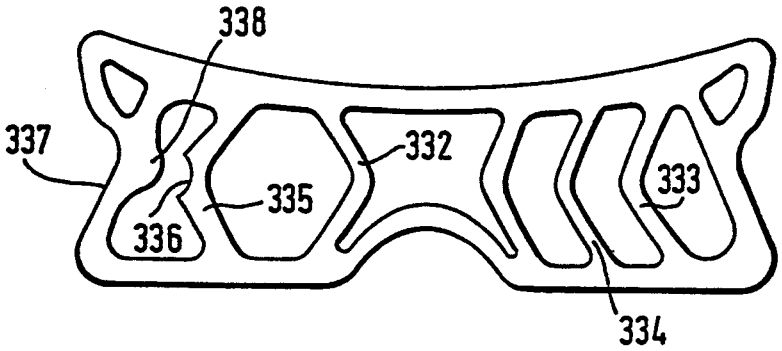

The cross-section shown in FIG. 24 comprises, in the half on the right of the annularly closed support profile portion 332, two additional angle portions 333 and 334 in which the angle apex points towards the centre. Arranged in the left-hand half of the cross-section is a support angle portion 335 whose angle apex faces outwardly and which has a notch 336 at the outward side of the apex of the angle. Associated with the notch 336, on the side wall 337 of the carrier element, is a projecting rib 338 which penetrates into the notch 336 and can be supported therein, in the course of deformation both of the support angle portion 335 and also of the side wall 337. At the moment at which contact occurs and the support effect begins, the stiffness of the left-hand half of the cross-sectional shape increases greatly so that it has a progressive spring characteristic.

Figure 25:
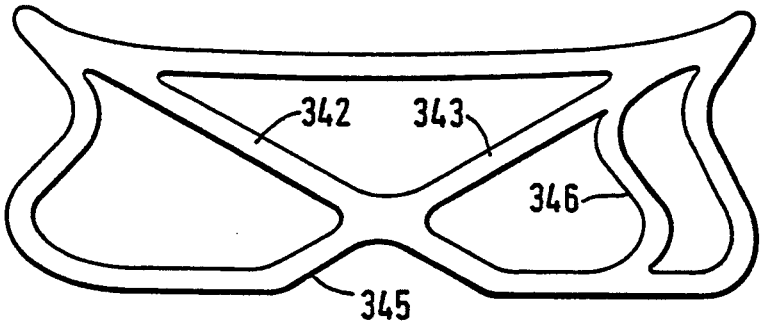
Figure 26:
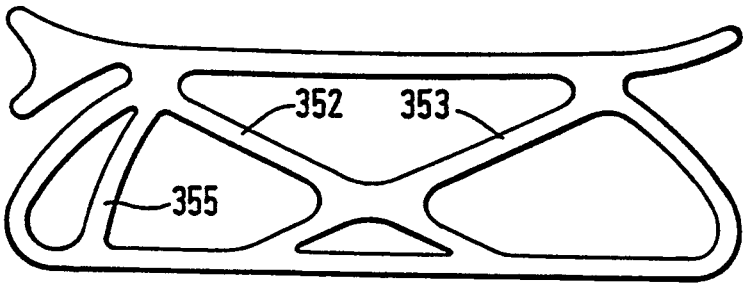

FIGS. 25 and 26 show two variants of cross-sectional shapes of asymmetrical configuration, with a diagonal bracing means. In this arrangement, two mutually intersecting diagonal strut portions 342, 343 and 352, 353 respectively pass through the space formed by the upper web portion, the lower web portion and the side walls of the box cross-section, in such a way that the strut portions also pass through each other and are supported at the lower web portion. In the cross-sectional shape shown in FIG. 25, the lower web portion has a central curvature portion 345 and the right-hand half of the cross-section is stiffened by a substantially S-shaped support strut portion 346 which is connected to the lower web portion and to the diagonal strut portion 343. In the embodiment shown in FIG. 26 the lower web portion is of a smooth configuration throughout and the left-hand half of the cross-section is additionally stiffened by a substantially rectilinear support strut portion 355 which is connected to the lower web portion and to the point of connection between the diagonal strut portion 352 and the upper web portion.

FIGS. 27 and 28 show examples of cross-sections of carrier elements in which—similarly to the embodiment 24, support portions are provided in the cross-section, the support action of which occurs only after a certain degree of deformation of the carrier element. Those support portions are so combined with other support bracing means that their support action comes into effect in the event of an asymmetric loading from above only in one half of the cross-section and in that respect the result is a pronouncedly asymmetrical deformation characteristic.

Thus the embodiment shown in FIG. 27, in the undeformed condition, is of asymmetrical construction with in each case three support strut portions 361 and 362 respectively which are curved in an S-shape. The upper ends of the group 361 of support strut portions diverge relative to the upper ends of the group 362 of support strut portions while the lower ends of those two groups converge towards each other. The lower web portion has a pronounced curvature 365 and carries two laterally projecting support horns 366 and 367 which in the undeformed condition are disposed at a spacing of 2 to 3 mm from the respective innermost support strut portion 361 and 362 respectively. In the event of a precisely vertical loading the S-shape of the support strut portions 361 and 362 is uniformly increased, in the course of such deformation the upper halves of the respective inner support strut portions 361, 362 bearing against the end portions of the support horns 366 and 367 respectively. From the moment of contact therefore the vertical loading is also carried by the support horns. In that situation deformation is asymmetrical. If an eccentrical vertical loading occurs, as is encountered for example when striking the ground with the heel, then the one group of support strut portions is moved towards the associated support horn, by virtue of the deformation which occurs in that situation, but the other group moves away from the associated support horn. The additional support effect afforded by the support horns as described above therefore only occurs at one side.

FIG. 28, by means of a purely diagrammatic view, shows the above-discussed effect in connection with a cross-sectional shape in which a respective group each consisting of two S-shaped curved support strut portions 371 and 372 are arranged at each side of a central curvature 375. The position and orientation of the support strut portions 371, 372 substantially correspond to those found in the embodiment shown in FIG. 27. The difference is that each of the support strut portions 371, 372 has support horns 373, 374 and 376, 377 respectively in the region of the upper and lower S-shaped curvature, being in tangential relationship there in each case. The upper support horns 373, 374 converge towards each other while the lower support horns 376, 377 diverge relative to each other. The free ends of all support horns are at a spacing of for example 2 mm from the upper web portion and the lower web portion respectively.

If the carrier element is loaded by a central vertical force as shown in FIG. 28*b*, the cross-section is deformed symmetrically. After deformation, the degree of which causes the spacing which was hitherto present between the free ends of the support horns and the associated upper web portion and lower web portion respectively to be used up, the support horns come into contact with the upper web portion and the lower web portion respectively and thus give rise to a progressive increase in the level of spring stiffness. In that situation the deformation again takes place symmetrically. In the event of the inclinedly directed loadings as shown in FIGS. 28*c* and 28*d* on the other hand the S-shaped support strut portions are deformed differently from each other in the manner shown in the drawing. The result of that is that the support horns come into operation in the half of the cross-section towards which the loading acts while in the half of the cross-section which the effect of the force 'misses out', the support horns are not braced against the upper web portion and the lower web portion, in spite of the deformation of the support strut portions.

Although, in the preceding embodiments, carrier elements of the kind described are provided at least on the front sole portion and the rear sole portion and in some embodiments also in the region of the arch of the foot, the invention is not restricted thereto. Thus, it is possible to envisage providing carrier elements of the kind and configuration described only in the rear sole portion (heel region) while the front sole portion and the arch region are formed in conventional manner by a flat sole layer, for example by a suitably shortened intermediate wedge portion. In that way that gives the anisotropic deformation characteristic discussed hereinbefore, only in the heel region in which the 'floating effect' which is to be avoided in that way, occurs in the most pronounced fashion by virtue of the thickness of the sole being at its greatest in the heel region and by virtue of the particular inclined loading after the foot has been put on to the ground. It is also possible to ensiage that in a departure from the embodiment of FIGS. 19 and 20 the carrier elements at the heel may not be arranged to extend transversely with respect to the longitudinal direction of the sole but parallel thereto, or, with the centre approximately in the arch region of the sole, diverging rearwardly in a radiating configuration.

The fixing of the carrier elements to the upper cover plate portion or cover layer may be effected by glueing with possibly additional assistance by means of a positive connection (see FIGS. 19 to 21). Instead of adhesive however it is also possible to use hot welding when employing thermoplastic materials, in particular ultrasonic welding. That is found to be advantageous in comparison with glueing insofar as the carrier elements only have to be positioned on the cover plate portion, possibly in an automatic operation by means of controlled grippers, and then the ultrasonic electrodes are moved into position and carry out the welding operation. That eliminates the step of previously applying adhesive with the inherent danger of contaminating adjoining parts.

If in the foregoing description comparisons are made about deformation characteristics and stiffness, as between the individual forms of the carrier elements, it will be appreciated that such comparisons are made on the assumption that the dimensions and material of the respective box profiles being considered are the same.

We claim:

1. A shoe bottom for a sport shoe, said shoe having a longitudinal direction, comprising:

a plurality of individual carrier elements of flexurally resilient material which are directed transversely with respect to the longitudinal direction of the shoe and which are arranged one behind the other in the longitudinal direction of the shoe;

a cover plate portion which covers the carrier elements on a foot side of said shoe and which is connected thereto;

an outsole which covers the carrier elements on an outward side of said shoe and which is connected thereto; and wherein each of the carrier elements is formed by a closed box profile portion with an upper web portion which extends transversely with respect to the longitudinal direction of the shoe, a lower web portion which is parallel to the upper web portion, two lateral support walls which connect the ends of the web portions together, and bracing means which support the upper web portion relative to the lower web portion; and wherein the lateral support walls are inwardly curved, each of said support walls including an apex; and further comprising a support strut portion disposed between the apex of each of the support walls and the upper web portion.

2. A shoe bottom according to claim 1, wherein the bracing means is formed by at least one support arch portion, and wherein said support arch portion includes ends which are attached to points on the lower web portion.

3. A shoe bottom according to claim 2, wherein the support arch portion forms a single upwardly-directed curvature, and wherein said curvature has an apex disposed approximately at the center of the upper web portion.

4. A shoe bottom according to claim 2, wherein the support arch portion includes a pair of upwardly-directed curvatures and a single downwardly-directed curvature positioned therebetween, and wherein said downwardly-directed curvature has an apex disposed approximately at the center of the lower web portion.

5.A shoe bottom according to claim 2, wherein the support arch portion has an apex which is fixedly connected to one of the upper and lower web portion.

6. A shoe bottom according to claim 3, wherein the support arch portion has an apex which is fixedly connected to one of the upper and lower web portion.

7. A shoe bottom according to claim 4, wherein the apex of the support arch portion is fixedly connected to one of the upper and lower web portion.

8. A shoe bottom according to claim 2, wherein the support arch portion has an apex which extends at a small spacing from one of the upper and lower web portion.

9. A shoe bottom according to claim 3, wherein the apex of the support arch portion extends at a small spacing from one of the upper and lower web portion.

10. A shoe bottom according to claim 4, wherein the apex of the support arch portion extends at a small spacing from one of the upper and lower web portion.

11. A shoe bottom according to claim 3, further comprising an annular support profile arranged between the apex of the support arch portion and the lower web portion.

12. A shoe bottom according to claim 4, further comprising an annular support profile arranged between the apex of the downwardly-directed curvature and the upper web portion.

13. A shoe bottom according to claim 11, wherein the annular support profile is fixedly connected to one of the apex of the support arch portion and the web portion.

14. A shoe bottom according to claim 12, wherein the annular support profile is fixedly connected to one of the apex of the support arch portion and the web portion.

15. A shoe bottom according to claim 3, further comprising a second support arch portion disposed under the first support arch portion, said second support arch portion having ends which are attached within the first support arch portion to the lower web portion, said second support arch portion further having an apex which is connected to the first support arch portion.

16. A shoe bottom according to claim 2, wherein the lower web portion has at least one local upwardly-directed curvature disposed between the points on the lower web portion at which the ends of the support arch portion are attached.

17. A shoe bottom according to claim 1, further comprising at least one annular support profile disposed between the upper and lower web portions and which is connected to one of the upper web portion and the lower web portion.

18. A shoe bottom according to claim 17, further comprising at least one upwardly-directed curvature formed in said lower web portion and disposed between respective adjacent annular support profiles.

19. A shoe bottom according to claim 1, wherein the bracing means is arranged asymmetrically in the cross-section of the box profile relative to a central plane which is perpendicular with respect to the lower web portion.

20. A shoe bottom according to claim 17, wherein said bracing means includes an elliptical arc formed on one side of the annular support profile, said arc having an apex which is connected to the side wall adjacent thereto and ends which are connected by a strut portion spanning between the upper web portion and the lower web portion.

21. A shoe bottom according to claim 18, wherein said bracing means includes an elliptical arc formed on one side of the annular support profile, said arc having an apex which is connected to the side wall adjacent thereto and ends which are connected by a strut portion spanning between the upper web portion and the lower web portion.

22. A shoe bottom according to claim 19, wherein said bracing means includes an elliptical arc formed on one side of the annular support profile, said arc having an apex which is connected to the side wall adjacent thereto and ends which are connected by a strut portion spanning between the upper web portion and the lower web portion.

23. A shoe bottom according to claim 20, wherein the strut portion is curved outwardly.

24. A shoe bottom according to claim 20, wherein arranged on the other side of the annular support profile are support strut portions which connect the upper web portion to the lower web portion.

25. A shoe bottom according to claim 23, wherein arranged on the other side of the annular support profile are support strut portions which connect the upper web portion to the lower web portion.

26. A shoe bottom according to claim 24, wherein the support strut portions are curved.

27. A shoe bottom according to claim 20, wherein said bracing means further comprises a second arc arranged on the other side of the annular support profile, said second elliptical arc having an apex which is connected to the side wall adjacent thereto and ends which are attached to one of the upper and lower web portion and the annular support profile.

28. A shoe bottom according to claim 19, wherein the bracing means include diagonal strut portions which pass through each other, and wherein said strut portions are connected together by an additional support strut portion.

29. A shoe bottom according to claim 1, wherein the bracing means include support portions which in the unloaded condition of the carrier element maintain a spacing from the web portions and which, in the course of a loading on the carrier element, come into supporting contact with the web portions.

* * * * *

UNITED STATES PATENT AND TRADEMARK OFFICE

CERTIFICATE OF CORRECTION

PATENT NO. : 5,337,492
DATED : August 16, 1994
INVENTOR(S) : Anderie, et al

It is certified that error appears in the above-indentified patent and that said Letters Patent is hereby corrected as shown below:

| | |
|---|---|
| Column 3, line 20, | "a wave-lie configuration" should be --a wave-like configuration--; |
| Column 5, lines 51-52, | "portion 39" should be --portion 20--; |
| Column 9, line 52, | "at one era of" should be --at one end of--; |

UNITED STATES PATENT AND TRADEMARK OFFICE

CERTIFICATE OF CORRECTION

PATENT NO. : 5,337,492

DATED : August 16, 1994

INVENTOR(S) : Anderie, et al

It is certified that error appears in the above-indentified patent and that said Letters Patent is hereby corrected as shown below:

Column 11, line 36, "is of asymmetrical construction" should be --is of a symmetrical construction--;

Column 11, line 55, "is asymmetrical" should be --is symmetrical--.

Signed and Sealed this

Thirty-first Day of January, 1995

*Attest:*

*Attesting Officer*

Bruce Lehman

BRUCE LEHMAN

*Commissioner of Patents and Trademarks*